US008942585B2

(12) United States Patent
Funatsu

(10) Patent No.: US 8,942,585 B2
(45) Date of Patent: Jan. 27, 2015

(54) IMAGE FORMING APPARATUS WITH DETECTION PART THAT DETECTS COLOR CONCENTRATION DETECTION PATTERN

(71) Applicant: Oki Data Corporation, Tokyo (JP)

(72) Inventor: Kenichi Funatsu, Tokyo (JP)

(73) Assignee: Oki Data Corporation, Tokyo (JP)

( * ) Notice: Subject to any disclaimer, the term of this patent is extended or adjusted under 35 U.S.C. 154(b) by 194 days.

(21) Appl. No.: 13/659,993

(22) Filed: Oct. 25, 2012

(65) Prior Publication Data

US 2013/0108294 A1 May 2, 2013

(30) Foreign Application Priority Data

Oct. 28, 2011 (JP) ..... 2011-237914

(51) Int. Cl.
*G03G 15/00* (2006.01)
*G03G 15/01* (2006.01)

(52) U.S. Cl.
CPC ..... *G03G 15/0189* (2013.01); *G03G 15/5058* (2013.01); *G03G 2215/0129* (2013.01); *G03G 2215/0161* (2013.01)
USPC ..... 399/49

(58) Field of Classification Search
USPC ..... 399/49
See application file for complete search history.

(56) References Cited

U.S. PATENT DOCUMENTS

2004/0096231 A1 * 5/2004 Furno et al. ..... 399/49
2004/0213593 A1 * 10/2004 Brewington et al. ..... 399/27
2006/0024076 A1 * 2/2006 Kato et al. ..... 399/49
2006/0222382 A1 * 10/2006 Gady et al. ..... 399/27
2007/0091390 A1 * 4/2007 Kimura et al. ..... 358/500
2007/0183801 A1 * 8/2007 Takeuchi et al. ..... 399/49
2008/0107434 A1 * 5/2008 Toyohara ..... 399/62
2008/0131150 A1 * 6/2008 Tomita et al. ..... 399/39
2009/0245822 A1 * 10/2009 Nagatsuka et al. ..... 399/43
2010/0027035 A1 * 2/2010 Stelter et al. ..... 358/1.9
2010/0067928 A1 * 3/2010 Ozawa ..... 399/39
2011/0058823 A1 * 3/2011 Hirai ..... 399/15
2011/0123209 A1 * 5/2011 Akita ..... 399/49
2011/0182608 A1 * 7/2011 Toyohara ..... 399/72

FOREIGN PATENT DOCUMENTS

JP 2008-164656 A 7/2008

* cited by examiner

*Primary Examiner* — David Bolduc
(74) *Attorney, Agent, or Firm* — Muncy, Geissler, Olds & Lowe, P.C.

(57) ABSTRACT

An image forming apparatus includes an image forming part that forms a developer image, transfers the developer image to an intermediate transfer belt at a first transfer position and the developer image on the intermediate transfer belt to a sheet at a second transfer position. The image forming apparatus includes a detection part located between the first transfer position and the second transfer position and configured to detect a concentration of the developer image; and a controller configured to start a transfer of a concentration detection pattern that is a developer image for concentration detection during a period from when the developer image for print is transferred to the intermediate transfer belt to when the developer image for print is transferred to the sheet, and then to control the detection part to read the concentration detection pattern.

10 Claims, 10 Drawing Sheets

IMAGE FORMING APPARATUS WITH DETECTION PART THAT DETECTS COLOR CONCENTRATION DETECTION PATTERN

CROSS REFERENCE TO RELATED APPLICATION

The present application is related to, claims priority from and incorporates by reference Japanese Patent Application No. 2011-237914, filed on Oct. 28, 2011.

TECHNICAL FIELD

The present invention relates to an image forming apparatus that prints multi color images by an electrographic method and especially relates to an intermediate transfer method image forming apparatus.

BACKGROUND

An intermediate transfer method color printer that is currently widely distributed as an image forming apparatus automatically conducts concentration detection and color shift detection every elapse of a constant duration or every certain print pages, and conducts correction based on detection results. However, correction for the concentration detection and the color shift detection needs time. Therefore, performance of the next printing is not allowed during the correction, which generates an inconvenience.

To solve such an inconvenience, an image forming apparatus disclosed in Japanese Laid-Open Patent Application No. 2008-164656 has been proposed, for example. The image forming apparatus uses a reading sensor (concentration sensor), which moves in a shift direction of a roller, to read an toner image so that performance time for a detection operation is shortened (For example, see Japanese Laid-Open Patent Application No. 2008-164656).

However, there is a problem in the above-discussed image forming apparatus disclosed in Japanese Laid-Open Patent Application No. 2008-164656 that reading the toner image formed by the reference image needs time when movement speed of the reference image detection unit and/or the reading sensor is slow since the reference image detection unit for detecting the reference image and the reading sensor move. Therefore, there are only small effects with respect to shortening the time needed for the reference image detection.

One of objects of the present invention is to solve such a problem.

SUMMARY

Accordingly, an image forming apparatus of the invention, in which an image forming part that forms a developer image is located close to an endless intermediate transfer belt, configured to transfer the developer image that is formed by the image forming part to the intermediate transfer belt at a first transfer position and to carry the developer image, then to transfer the developer image on the intermediate transfer belt to a sheet at a second transfer position, the image forming apparatus includes a detection part located between the first transfer position and the second transfer position and configured to detect a concentration of the developer image on the intermediate transfer belt; and a controller configured to start a transfer of a concentration detection pattern that is a developer image for concentration detection to the intermediate transfer belt during a period from when the developer image for print that is the developer image based on print data input from an external part is transferred to the intermediate transfer belt to when the developer image for print is transferred to the sheet, and then to control the detection part to read the concentration detection pattern.

The concentration sensor is located at the position between the first transfer position and the second transfer position of the developer images on the intermediate transfer belt that carries the developer images so as to face the surface of the intermediate transfer belt. The pattern generation part starts the generation of the concentration detection patterns after the finish of the formation of the final developer image that is printed on the sheet, and each of the generated developer images of the concentration detection patterns in the respective colors is transferred to the intermediate transfer belt. Each of the developer images in the respective colors is read as the concentration detection data by the concentration sensor. Therefore, the present invention with such a configuration has an advantage to shorten the time needed for the concentration detection.

DETAILED DESCRIPTION OF EMBODIMENTS

Embodiments of an image forming apparatus according to the present invention are explained below with reference to the figures.

First Embodiment

Figure 1:
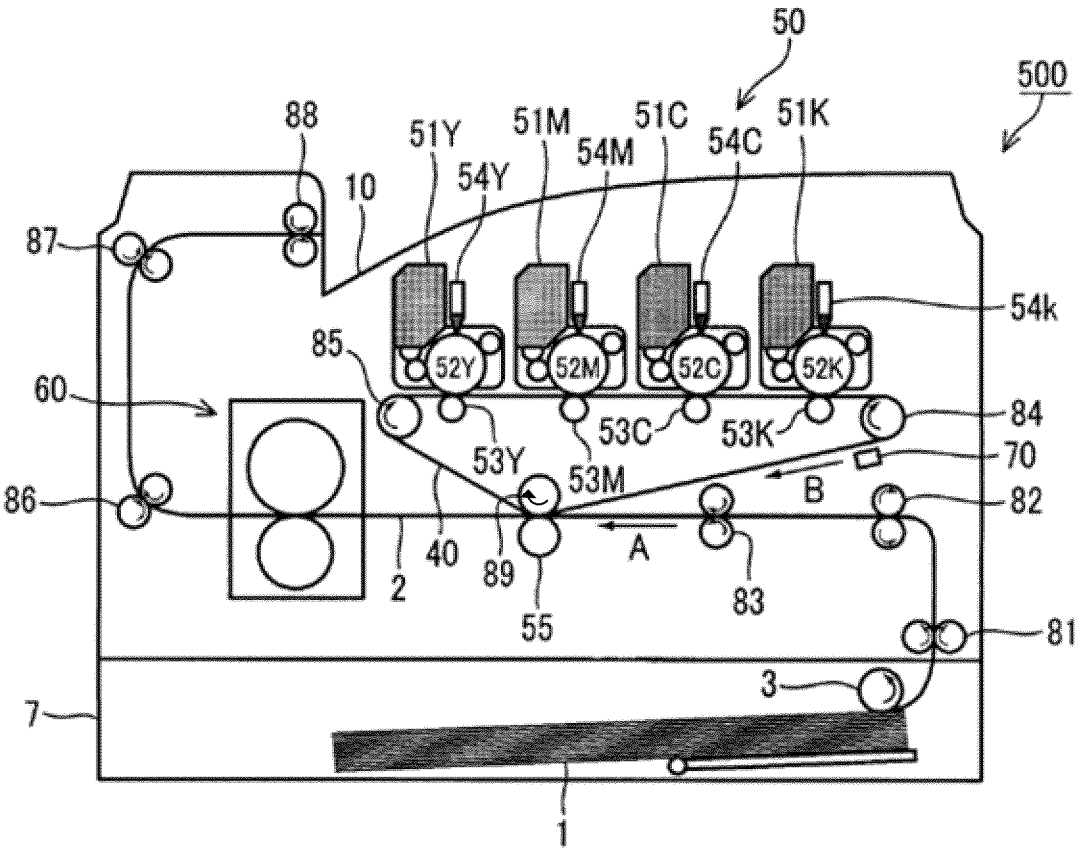
FIG. 1 is a schematic side view schematically illustrating an internal configuration of a first embodiment.

FIG. 1 is a schematic side view schematically illustrating an internal configuration of a first embodiment. A printer 500 that is an image forming apparatus of the present embodiment includes a medium carrying path 2, a pickup roller 3, a medium containing tray 7 that accommodates sheets 1 such as paper and the like, a medium stacking tray 10, an endless intermediate transfer belt (intermediate transfer body) 40, an image forming part 50, a heat fusion part 60, a concentration sensor 70, carrying rollers 81, 82, 83, 86, 87 and 88 and belt support rollers 84, 85 and 89. Here, the pickup roller 3, the carrying rollers 81, 82, 83, 86, 87 and 88 and the belt support rollers 84, 85 and 89 rotate in respective arrow directions in FIG. 1.

The pickup roller 3 is located in a front edge side of the medium containing tray 7. Each of the sheets 1 that is accommodated in the medium containing tray 7 is picked up by the pickup roller 3, and is sent to the medium carrying path 2. The carrying rollers 81, 82 and 83 are located along the medium carrying path 2. The sheet 1 that has been sent to the medium carrying path 2 by the pickup roller 3 is carried in a direction illustrated in an arrow A in FIG. 1 by the carrying rollers 81, 82 and 83.

The intermediate transfer belt 40 is supported by the belt support rollers 84, 85 and 89, and travels in an arrow B direction in FIG. 1 by rotation of at least one of the belt support rollers 84, 85, and 89. The belt support roller 89 is located at a position on the downstream side of the carrying rollers 83 in the medium carrying direction so that the belt support roller 89 allows the intermediate transfer belt 40 to contact the medium carrying path 2.

The image forming part 50 includes toner image forming parts 51Y, 51M, 51C and 51K (or developer image forming parts, yellow: hereinafter Y, magenta: hereinafter M, cyan: hereinafter C, black: hereinafter K), photosensitive bodies (e.g. photosensitive drums) 52Y, 52M, 52C and 52K, primary transfer rollers (primary transfer parts) 53Y, 53M, 53C and 53K and image writing heads 54Y, 54M, 54C and 54K. The toner image forming parts 51Y, 51M, 51C and 51K undertake toner (or developer) in respective different four colors, and form respective toner images. The photosensitive drums 52Y, 52M, 52C and 52K are located between the belt support rollers 84 and 85 and along the surface of the intermediate transfer belt 40 so as to come close to the surface thereof. The primary transfer rollers 53Y, 53M, 53C and 53K are located at first transfer positions, respectively, so as to face the photosensitive drums 52Y, 52M, 52C and 52K across the intermediate transfer belt 40.

A developer of the present invention means toner, ink or the like used for visualizing an image. Particularly, the toner is a material or agent to visualize a latent image that is formed on a photosensitive body. There is no limitation for the developer regarding the number of materials or the types. A single component developer, which is configured with only toner, as well as two component developer, which is configured with carrier together with toner, are available. Either wet type or dry type can be selected according to the purpose. Either magnetic type or non-magnetic type developer as well can be selected. In the embodiment(s) disclosed in the application, toner is used for the developer. A toner image is one embodiment of the developer image.

In addition, the image writing heads 54Y, 54M, 54C and 54K are parts that write images (electrostatic latent images) onto the photosensitive drums 52 based on image data that is input by a host device and the like by light irradiation. The toner image forming parts 51Y, 51M, 51C and 51K supply toner to the images that are written on the photosensitive drums 52Y, 52M, 52C and 52K to form toner images. Each of the toner images that have been formed on the respective photosensitive drums 52Y, 52M, 52C and 52K is transferred onto the intermediate transfer belt 40 by the primary transfer rollers 53Y, 53M, 53C and 53K, which form a toner image on the intermediate transfer belt 40. The image forming part 50 is configured from a plurality of color image forming parts that correspond to the respective colors.

The concentration sensor 70 is a detection part that detects a concentration of the toner image that is transferred onto the intermediate transfer belt 40, and is located at a position between the belt support rollers 84 and 89 so as to face the surface of the intermediate transfer belt 40.

A secondary transfer roller 55 (secondary transfer part) is located at a second transfer position so as to face the belt support roller 89 across the medium carrying path 2 and the intermediate transfer belt 40. The secondary transfer roller 55 transfers the toner image that is transferred onto the intermediate transfer belt 40 to the sheet 1 that has been carried on the medium carrying path 2.

The heat fusion part 60 performs a fusion process by applying heat and pressure on the sheet 1 on which the toner image has been transferred to fix the toner image on the sheet 1. The heat fusion part 60 is located on the downstream side of the secondary transfer roller 55 in the medium carrying direction.

The carrying rollers 86, 87 and 88 are located on the downstream side of the heat fusion part 60 in the medium carrying direction. The carrying rollers 86, 87 and 88 carry the sheet 1 after the fusion process in a direction of the medium stacking tray 10. The medium stacking tray 10 is a part that stacks the sheet 1 that has been ejected by the carrying rollers 88.

Figure 2:
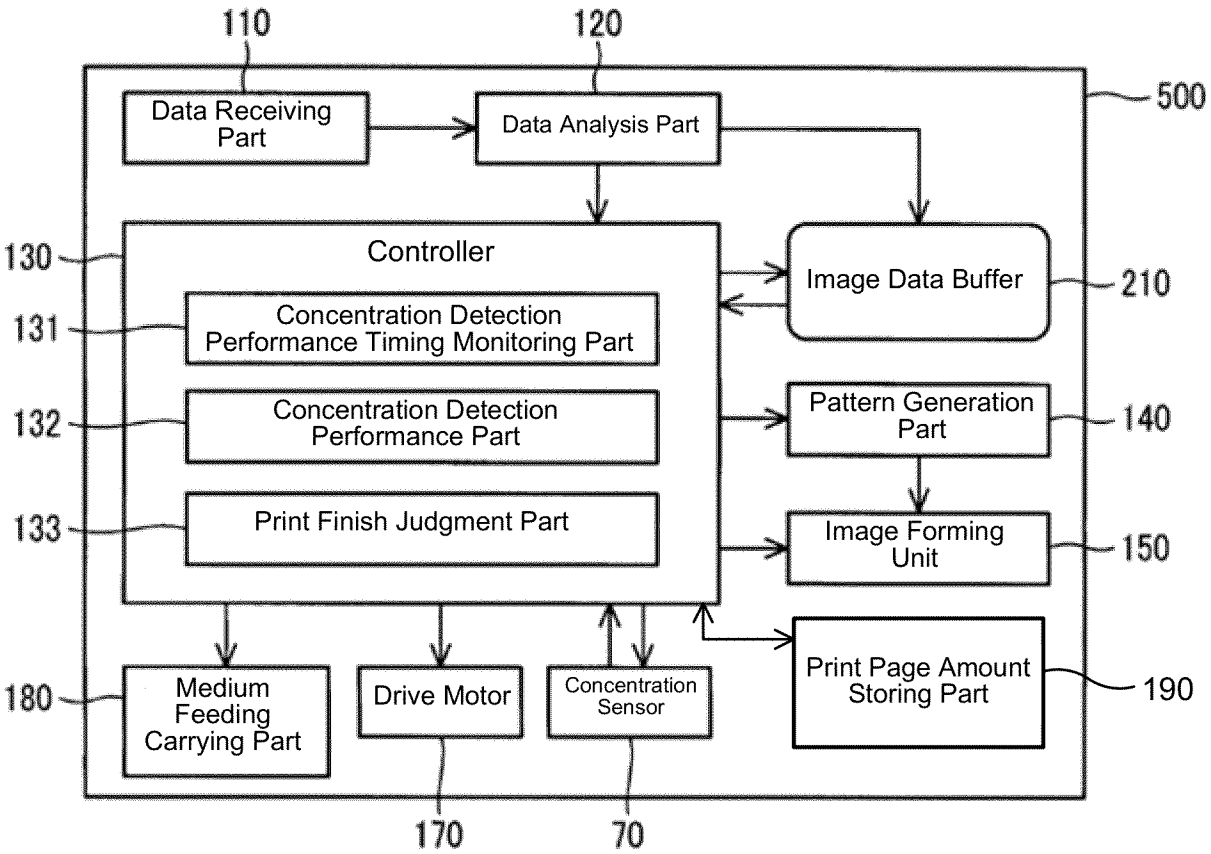
FIG. 2 is a functional block diagram of a control system of the first embodiment.

FIG. 2 is a functional block diagram of a control system of the present embodiment. As illustrated in FIG. 2, the control system includes a data receiving part 110, a data analysis part 120, a controller 130, a pattern generation part 140, an image forming unit 150, a drive motor 170, a medium feeding carrying part 180, a print page amount storing part 190 and an image data buffer 210.

Here, the data receiving part 110 has functions for receiving print job data that is transmitted from the host device and transferring the data to the data analysis part 120. The data analysis part 120 has a function of analyzing the print job data that has been transferred from the data receiving part 110 into respective colors Y, M, C, K to digitize a print image and to store the analyzed data in the image data buffer 210, and has a function of notifying the controller 130.

The controller 130 has a function for reading the print image data from the image data buffer 210 and for transferring the image data to the image forming unit 150 when the controller 130 receives a notice of the print image data storing from the data analysis part 120. The controller 130 has a function for instructing the pattern generation part 140 to generate concentration detection patterns (reference images) at predetermined timing. The controller 130 has a function for controlling operations of the concentration sensor 70, the drive motor 170 and the medium feeding carrying part 180. The controller 130 includes a concentration detection performance timing monitoring part 131 (concentration detection performance judgment part), a concentration detection performance part 132 and a print finish judgment part 133.

The concentration detection performance timing monitoring part 131 in the controller 130 performs a control of timing for generating the concentration detection patterns, and stores a counted value of the print pages in a nonvolatile memory described later. In addition, the concentration detection performance part 132 conducts the concentration detection based on light receiving amount data from the concentration sensor 70. The print finish judgment part 133 judges whether or not the print job has been finished.

The pattern generation part (reference image generation part) 140 is a part that generates the concentration detection patterns (reference images) for correcting the concentrations of the print images (toner images) in accordance with instructions from the controller 130. The image forming unit 150 is configured by the image forming part 50, the secondary transfer roller 55 and the heat fusion part 60 shown in FIG. 1. The image forming unit 150 forms the toner images formed based on the images for printing by the control of the controller 130, transfers the toner images onto the intermediate transfer belt 40, prints (transfers and fixes) the toner images onto the sheet 1, and the image forming part 1 forms toner images formed based on the concentration detection patterns that the pattern generation part 140 has generated, and transfers the toner images onto the intermediate transfer belt 40.

The concentration sensor 70 is located so as to face the surface of the intermediate transfer belt 40 as illustrated in FIG. 1, reads the toner image formed by the concentration detection patterns that is formed on the intermediate transfer belt 40 in accordance with the control of the controller 130, and transmits the read data to the controller 130.

The drive motor 170 is a module included in the printer 500, that is, the drive motor 170 is a drive source that drives the pickup roller 3, the intermediate transfer belt 40, the photosensitive drums 52Y, 52M, 52C and 52K, the primary transfer rollers 53Y, 53M, 53C and 53K, the secondary transfer roller 55, the heat fusion part 60, the carrying rollers 81, 82, 83, 86, 87 and 88, the belt support rollers 84, 85 and 89 and the like in accordance with the control of the controller 130. Only one rive motor 170 is shown in the FIG. 2. However, a number of drive motors 170 may be provided as needed.

The medium feeding carrying part 180 feeds and carries the sheet 1 in accordance of the control of the controller 130 and is configured by the pickup roller 3 and the carrying rollers 81, 82, 83, 86, 87 and 88 and the like.

Figure 3A:
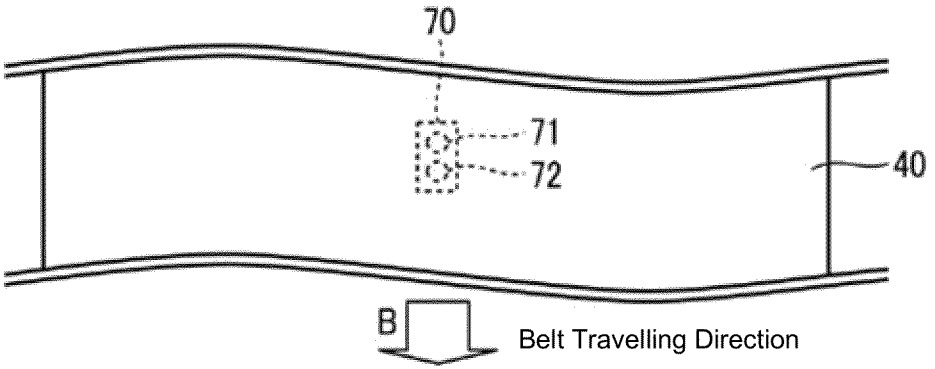
FIGS. 3A and 3B are explanatory diagrams of the concentration detection performed in the first embodiment.
Figure 3B:
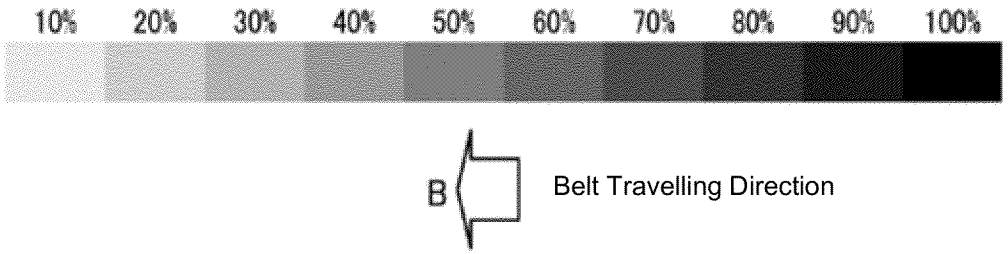

FIGS. 3A and 3B are explanatory diagrams of the concentration detection performed in the present embodiment. FIG. 3A illustrates the concentration sensor 70 seen from above across the intermediate transfer belt 40. FIG. 3B illustrates an example of the concentration detection pattern.

The intermediate transfer belt 40 travels in the arrow B direction in FIG. 3A as shown in FIG. 3A. A light emitting part 71 is placed on the upstream side of the concentration sensor 70 of the belt travelling direction and a light receiving part 72 is placed on the downstream side of the concentration sensor 70 in the belt travelling direction. The light receiving part 72 receives reflection light of the light that the light emitting part 71 has irradiated toward the toner image on the intermediate transfer belt 40. The controller 130 measures a reflection ratio of the toner image on the intermediate transfer belt 40 in accordance with the light receiving amount data of the light receiving part 72.

In addition, the concentration detection pattern of the present embodiment is produced so as to make a gradation, of which the concentration deepens gradually like 10%, 20%, 30%, . . . 90%, and 100% in the travelling direction of the intermediate transfer belt 40 as shown in FIG. 3B, for example.

In the concentration detection in the present embodiment, the pattern generation part 140 generates the concentration detection pattern shown in FIG. 3B in accordance with the timing that the concentration detection performance timing monitoring part 131 has designated. The image forming part 50 of the image forming unit 150 forms the concentration detection patterns as the toner images onto the photosensitive drums 52Y, 52M, 52C and 52K, and transfers the concentration detection patterns onto the travelling intermediate transfer belt 40.

When a leading end of the toner image formed by the concentration detection patterns, which are transferred onto the intermediate transfer belt 40, reaches the concentration sensor 70, the controller 130 causes the light emitting part 71 of the concentration sensor 70 to emit, and the light receiving part 72 receives light. The controller 130 then starts the measurement of the reflection ratio. At this time, the reflection ratio of the light in a region on which the toner image on the intermediate transfer belt 40 is not formed at all is the highest while the reflection ratio of the light in a region on which the toner image is formed to turn higher in proportion to the exposure degree of the surface of the intermediate transfer belt 40. By using such reflection ratios, the controller 130 causes the concentration detection performance part 132 to measure the reflection ratios in the respective concentrations of the concentration detection pattern shown in FIG. 3B. The controller 130 treats the reflection ratios as concentration detection data, conducts comparison of the concentration detection data measured in the respective concentrations with a regulated value decided in advance, and conducts the correction (adjustment) when a shift (error) exists. Thereby, the maintenance of the appropriate concentration of the print image is possible.

The timing for performing the concentration detection is conducted at every certain print page amount, for example, every 500 sheets generally.

Figure 4:
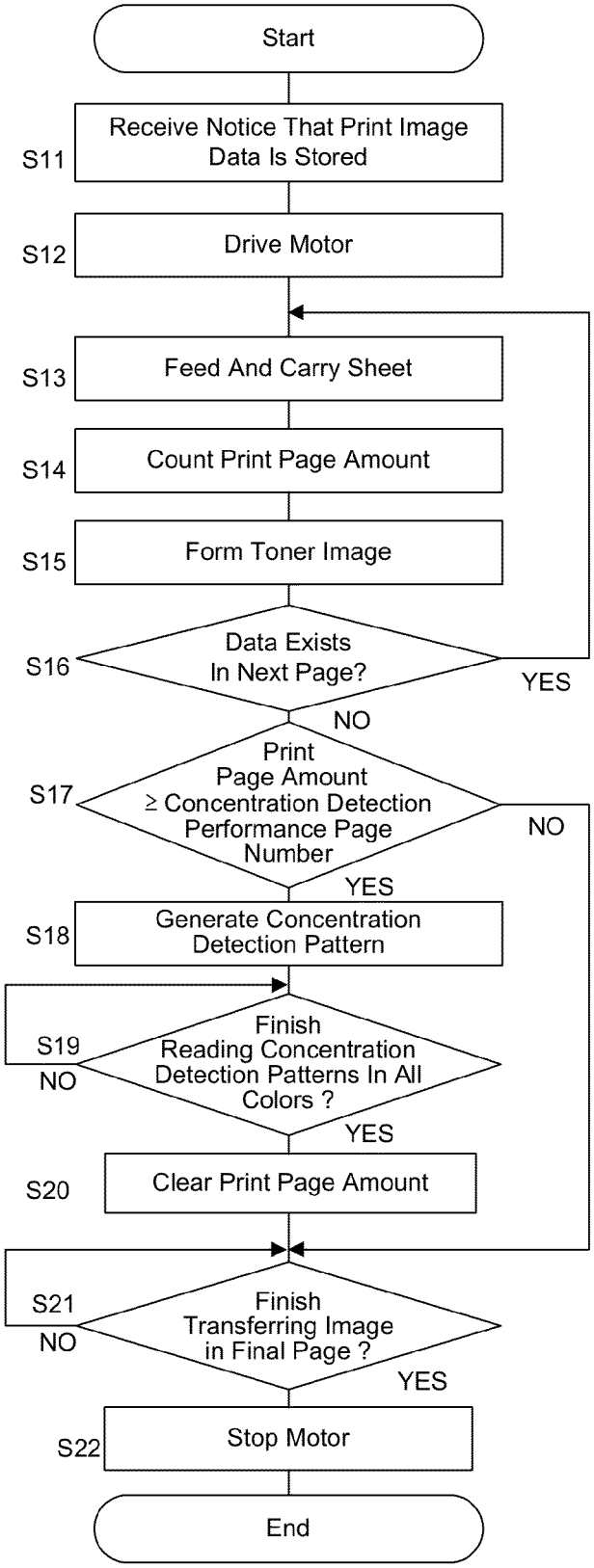
FIG. 4 is a control flow diagram of a controller in the first embodiment.

FIG. 4 is a control flow diagram of the controller 130 in the first embodiment. An action of the above-discussed configuration is explained according to the flow diagram. An operation of each part that are explained below is controlled by the controller 130 based on a program (software) that is stored in a memory part (not shown).

Firstly, when the controller 130 receives a notice of storage of the print image data from the data analysis part 120 (S11), the controller 130 drives the drive motor 170 (S12), and instructs the medium feeding carrying part 180 to feed and carry each sheet while the print job of the print image data exists. Thereby, the sheet 1 is fed from the medium containing tray 7, and is carried along the carrying path 2 (S13). Then, every time each sheet 1 is fed, the controller 130 counts the print page amount (S14).

Next, the controller 130 performs a series of printing operations that include formation of toner images that are the print images in each color Y, M, C and K by controlling the image forming unit 150 (S15), transfer of each toner image to the intermediate transfer belt 40, transfer of the toner image from the intermediate transfer belt 40 to the sheet 1, and fusion of the toner image on the sheet 1 by the heat fusion part 60, and repeats the operations until the print job finished. As counted value of the print page amount is stored in the print page amount storing part 190, the counter value remains even when a power source of the apparatus is turned off. The print page amount storing part 190 is a nonvolatile memory (electrically erasable programmable read-only memory (EEPROM) or the like) and stores the counted value of the printed page amount therein.

During the formation of the toner images (e.g. during the formation of a toner image in the first color Y) the controller 130 determines the existence of the print image data in the next page (S16), and repeats the operations from S13 when the print image date of the next page exists. The concentration detection performance timing monitoring part 131 judges whether or not the print page amount is equal to or more than the concentration detection performance page amount (reference page amount) when the print image date of the next page does not exist and a page that is currently processed is the final page (S17). When the print page amount is equal to or more than the concentration detection performance page amount, the concentration detection performance timing monitoring part 131 instructs the pattern generation part 140 to generate the concentration detection pattern in the color after the print image formation. The timing at the concentration detection pattern generation is discussed below.

Each generated concentration detection pattern is formed as a toner image onto each photosensitive drum 52Y, 52M, 52C and 52K of the image forming unit 150 (S18), each concentration detection pattern (toner image) in each color is read as the concentration detection data by the concentration sensor 70 after each generated concentration detection pattern has been transferred onto the intermediate transfer belt 40. At this time, an interval between the toner image formed by the print image and the toner image formed by the concentration detection pattern is ensured to be at least long enough so that the toner image formed by the concentration detection pattern is not transferred to a margin on the trailing edge of the sheet 1.

The secondary transfer roller 55 is positively-charged desirably when the toner image formed by the print image is transferred to the sheet, and the secondary transfer roller 55 is negatively-charged desirably when the toner image formed by the concentration detection pattern passes the second transfer position when the toner that forms the toner image is negatively chargeable toner. A predetermined interval between the toner image formed by the print image and the toner image formed by the concentration detection pattern is ensured to obtain time period (two seconds, for example) that allows the switch of charge polarities of the secondary transfer roller 55.

The controller 130 determines whether or not the reading of the toner images formed by the concentration detection patterns in all colors based on outputs of the concentration sensor 70 has been finished when the formation of the toner images formed by the concentration detection patterns has been conducted (S19). The counted value of the print page amount is cleared when the reading has been finished (S20). Thereafter, the controller 130 determines whether or not the transfer of the image for the final page on the sheet 1 has been finished (S21). The controller 130 stops the motor (S22) when the transfer has been finished. The controller 130 waits the finish of the transfer, and stops the motor when the transfer has been finished when the transfer of the image in the final page has not been finished.

Meanwhile, the formation of the concentration detection patterns is not conducted when the controller 130 judges that the print page amount is not equal to or more than the concentration detection performance page amount in the judgment in S17. The controller 130 determines whether or not the transfer of the image in the final page to the sheet has been finished (S21), and stops the motor when the transfer has been finished (S22).

Next, the operation timing of the pattern generation part 140, the image forming unit 150, the concentration sensor 70, the drive motor 170 and the medium feeding carrying part 180 in the process for the concentration detection of the present embodiment is explained.

Figure 5A:
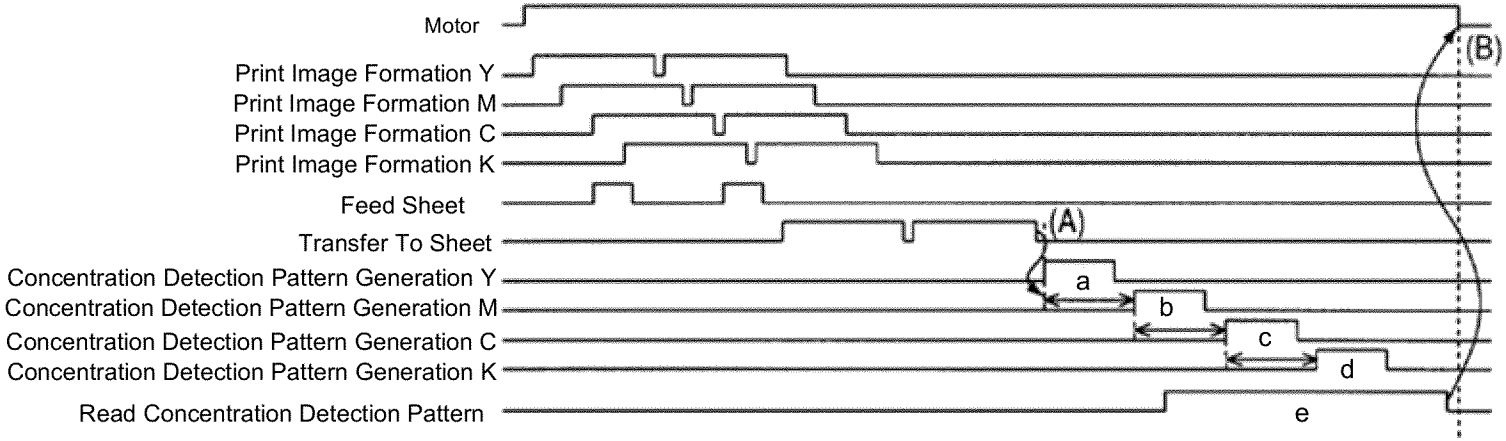
FIGS. 5A and 5B are time charts illustrating a process of the concentration detection in the first embodiment.
Figure 5B:
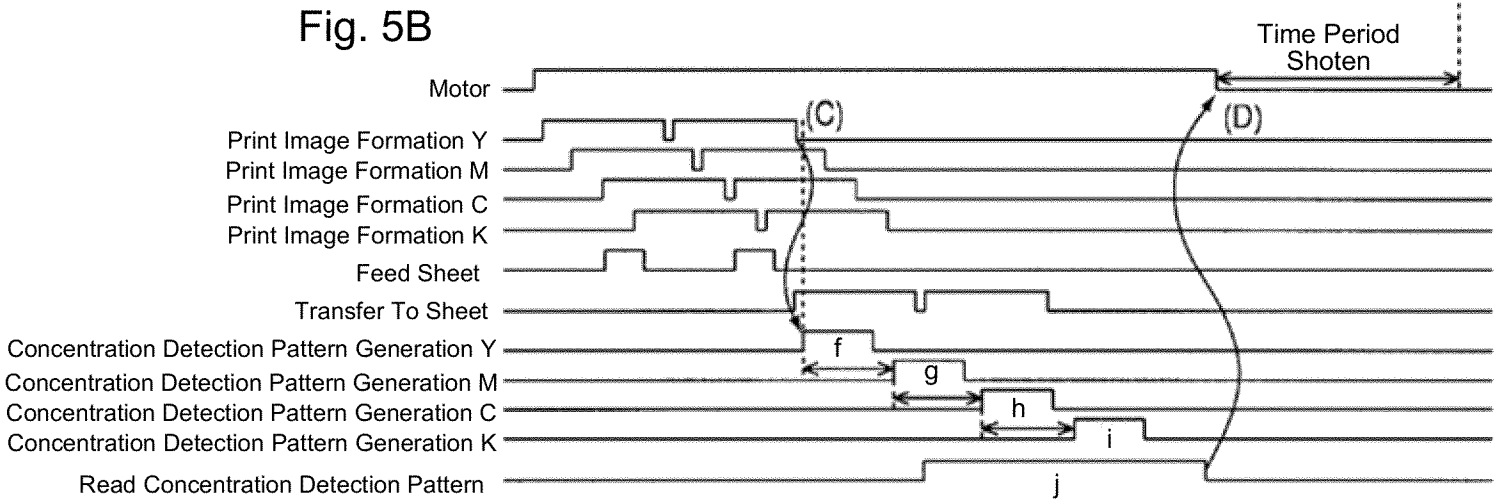

FIGS. 5A and 5B are time charts illustrating a process of the concentration detection. FIG. 5A illustrates a case when the concentration detection is conducted after the finish of the transfer of the toner image to the sheet according to a conventional art. FIG. 5 B illustrates a case when the concentration detection is immediately conducted after the formation of each of the toner images in the respective colors according to the present invention at the time of the printing of the final page every print job. Both of FIGS. 5A and 5B assume a job for printing two sheets.

In the case of FIG. 5A, after the activation of the drive motor 170, the image forming part 50 of the image forming unit 150 forms each print image (toner image) in each of Y, M, C and K. The transfer of each print image is performed to the sheet 1, which is supplied by the medium feeding carrying part 180 at the timing of the formation of the toner image, by the secondary transfer roller 55 of the image forming unit 150.

At the timing (A) when the transfer to the second sheet that is the final page has been finished, the pattern generation part 140 generates each concentration detection pattern in each color (a, b, c, d). The concentration sensor 70 starts the reading of the toner image formed by the concentration detection pattern after a predetermined time period from the generation of the first concentration detection pattern Y (e). After the generation of the final end color concentration detection pattern K (d), the concentration sensor 70 ends the reading of the toner images formed by the concentration detection pattern after the predetermined time period has elapsed. Thereafter, the drive motor 170 stops. The character (B) in FIG. 5A illustrates the timing at the stop.

By controlling in the manner mentioned above, the reading of each toner image formed by each concentration detection pattern in each color is conducted.

Meanwhile, in the case of the present embodiment illustrated in FIG. 5B, after the activation of the drive motor 170, the image forming part 50 of the image forming unit 150 forms each print image (toner image) in each of Y, M, C and K. The transfer of each toner image is performed to the sheet 1, which is supplied by the medium feeding carrying part 180 at the timing of the formation of the toner image, by the secondary transfer roller 55 of the image forming unit 150. When the formation of the toner image in Y of the second sheet that is the final page has been finished, the pattern generation part 140 immediately starts the generation of the concentration detection pattern after the timing (C), and generates the concentration detection pattern Y (f). In the same manner as Y, after the finish of the image formation on the second sheet, the pattern generation part 140 generates the concentration detection patterns M, C and K without waiting the finish of the transfer to the sheet (g, h, i).

Here, the timing (C) is the earliest timing among timings to ensure an interval where the toner image formed by the concentration detection pattern is not transferred on a margin on the trailing edge of the sheet 1 and to obtain time period that allows the switch of the charge polarities of the secondary transfer roller 55.

Then, the concentration sensor 70 starts the reading of the toner image formed by the concentration detection pattern after the predetermined time period from the generation of the first concentration detection pattern Y (j). After the generation of the final end color concentration detection pattern K (i), the concentration sensor 70 ends the reading after the predetermined time period has elapsed. Thereafter, the drive motor 170 stops. Since the generation the pattern generation part 140 and reading of the concentration detection patterns are started without waiting the transfer to the second sheet 1, the drive motor 170 stops at the timing (D), and as a result, the time period for the concentration detection in the present embodiment is shorter by the time between the timing (B) shown in FIG. 5A and the timing (D) shown in FIG. 5B in comparison with the concentration detection according to the conventional art.

Each of arrows shown at respective portions of the respective concentration detection pattern generations in the respective colors (a, b, c, d, f, g, h, i) in FIGS. 5A and 5B indicates a time length to the start of the generation of a concentration detection pattern in a next color. Each time length is defined by the following formula: (Pattern length)+(Distance between photosensitive drums)−(Distance between image writing head and primary transfer roller) Each trail edge of each arrow indicates the timing of the start of the generation of the concentration detection pattern in the next color.

As explained above, in the first embodiment, the concentration sensor 70 is located at the position between the first transfer position and the second transfer position to which each of the toner images on the intermediate transfer belt 40 that carries the toner images so as to face the surface of the intermediate transfer belt 40. The pattern generation part 140 starts the generation of the concentration detection pattern after the finish of the formation of the toner image in the final page that is printed on the sheet 1, and each of the generated toner images of the concentration detection patterns in the respective colors is transferred to the intermediate transfer belt 40. The toner images in the respective colors are read as the concentration detection data by the concentration sensor 70. Thereby, the time period needed for the concentration detection is shortened advantageously. In addition, rotation amounts of the intermediate transfer belt 40 and the photosensitive drums 52Y, 52M, 52C and 52K that are consumable items are reduced by the time period. As a result, consumption amounts of the consumable items calculated by the rotation amounts are suppressed advantageously.

Second Embodiment

A second embodiment is explained. An internal configuration of the second embodiment is similar to that of the first embodiment shown FIG. 1.

Figure 6:
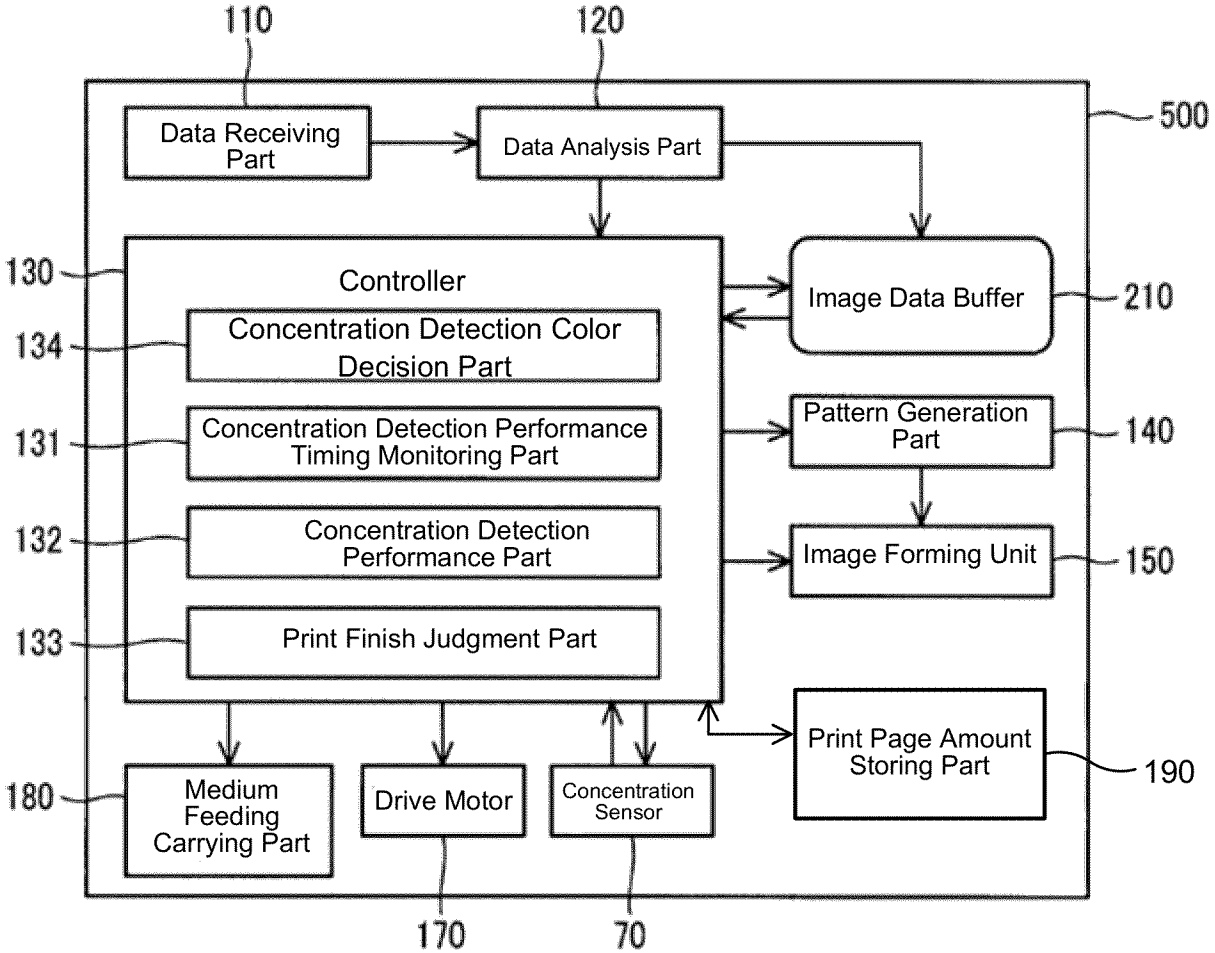
FIG. 6 is a functional block diagram of a control system of a second embodiment.

FIG. 6 is a functional block diagram of a control system of the second embodiment. The concentration detection color decision part (color judgment part) 134 that decides colors of the detection patterns (colors of the reference images) that performs the concentration detection after finish of the print job is provided in the controller of the control system of the second embodiment. Other configurations are the same as those of the first embodiment shown in FIG. 2. Components that are the same as the first embodiment are indicated with the same symbols, and duplicative explanations are omitted.

Figure 7:
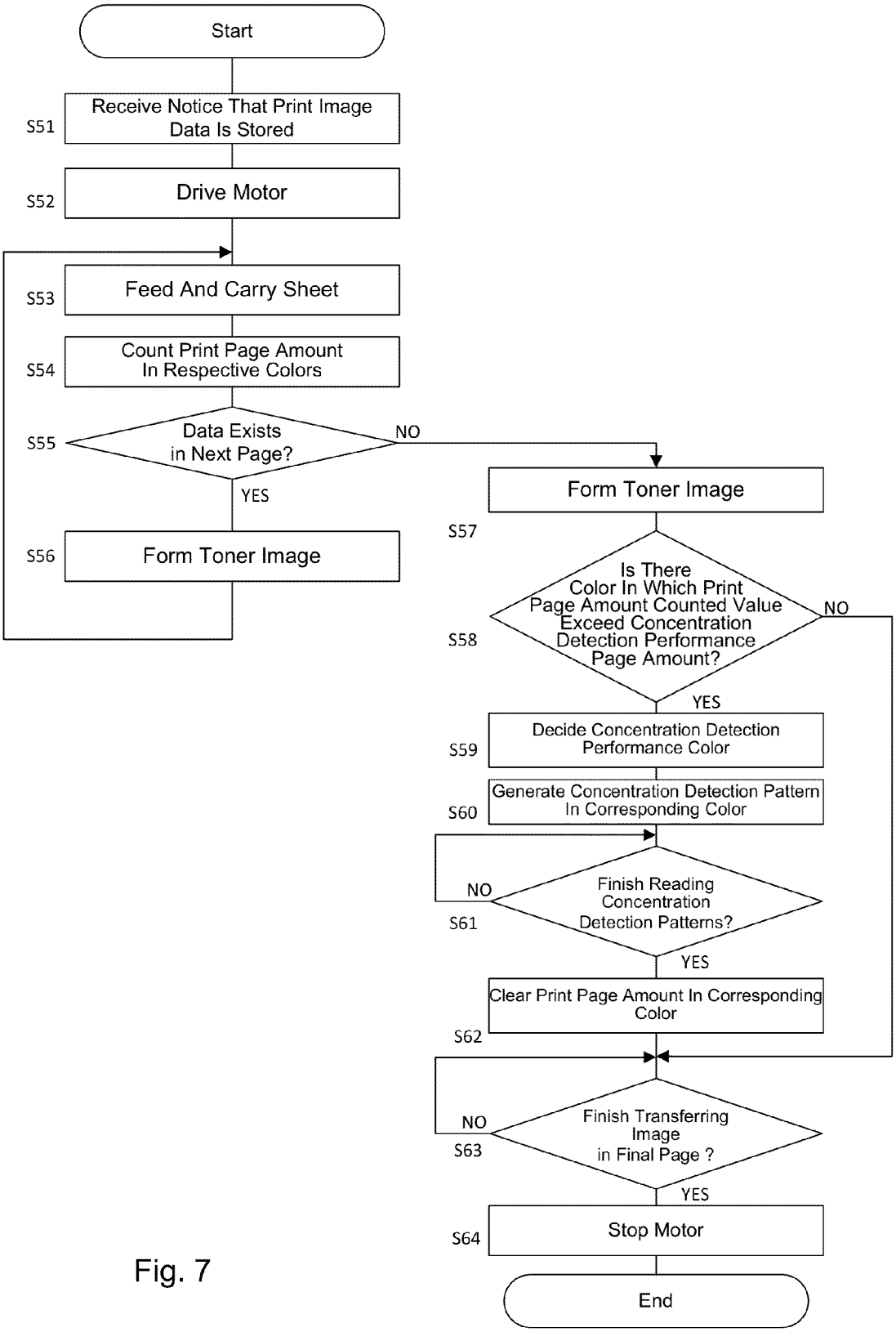
FIG. 7 is a control flow diagram of a controller in the second embodiment.

FIG. 7 is a control flow diagram of the controller 130 in the second embodiment. An action of the above-discussed configuration is explained according to the flow diagram. An operation of each part explained below is controlled by the controller 130 based on a program (software) that is stored in a memory part (not shown).

Firstly, when the controller 130 receives a notice of storage of the print image data from the data analysis part 120 (S51), the controller 130 drives the drive motor 170 (S52), and instructs the medium feeding carrying part 180 to feed and carry each sheet while the print job of the print image data exists. Thereby, the sheet 1 is fed from the medium containing tray 7, and is carried along the carrying path 2 (S53).

Next, the controller 130 conducts a series of printing operations that include conducting the count of print page amounts in respective colors that are used for printing (S54), determination of the existence of the date of the next page (S55), formation of each toner image that is the print image in each color Y, M, C, K by controlling the image forming unit 150 (S56) when the date of the next page exists, transfer of each toner image which is formed by the image forming unit 150 to the intermediate transfer belt 40, transfer of the toner image from the intermediate transfer belt 40 to the sheet 1, and fusion of the toner image on the sheet 1 by the heat fusion part 60, and repeats the operations until the print job is finished. As a counted value of the print page amount in each color is stored in the print page amount storing part 190, the counted value remains even when a power source of the apparatus is turned off.

Here, the count of the print page amount in each color is described specifically. A color (for example, Y) is determined as printed on one sheet when an amount of one dot of the color Y is transferred on the sheet, for example. That is, the counted value of the print page amount in the color Y increases by 1. In addition, a color (for example, Y) is printed on one sheet when 100 dots of the color Y are transferred on the sheet, for example. That is, the counted value of the print page amount for the color Y increases by 1.

If the data in the next page does not exists and the page that is currently processed is the last page (S55), a toner image that is the print image for each of colors Y, M, C and K is formed by controlling the image forming unit 150 (S57). Here, the concentration detection color decision part 134 conducts the judgment whether or not a print page amount counted value in each color exceeds the concentration detection performance page amount (S58). The concentration detection color decision part 134 decides the color as the concentration detection performance color when there is a color in which the print page amount counted value exceeds the concentration detection performance page amount (S59). Upon decision of the concentration detection performance color, the concentration detection color decision part 134 refers to each print page amount counted value for each color, and decides the color that has the largest print page amount counted value, that is, the color for which the concentration detection has not been conducted for the longest period as the concentration detection performance color.

If there is a color for which the concentration detection is performed (S60), the controller 130 instructs the pattern generation part 140 to generate the concentration detection pattern of the concentration detection performance color (S61). That is, the concentration detection pattern in the concentration detection performance color is generated after the toner image in the concentration detection performance color is formed as the print image. The timing at the concentration detection pattern generation is discussed below.

The generated concentration detection pattern is formed after the toner image has been formed as the print image on the photosensitive drum that corresponds to the concentration detection performance color among photosensitive drums 52Y, 52M, 52C and 52K. After the generated concentration detection pattern has been transferred onto the intermediate transfer belt 40, the concentration detection pattern is read by the concentration sensor 70. At this time, an interval between the toner image formed by the print image and the toner image formed by the concentration detection pattern is ensured to be at least long enough so that the toner image formed by the concentration detection pattern is not transferred to a margin on the trailing edge of the sheet 1.

The controller 130 determines whether or not the reading of the toner image formed by the concentration detection pattern has been finished based on an output of the concentration sensor 70 when the formation of the toner image formed by the concentration detection pattern has been conducted (S61). The counted value of the print page amount in the corresponding color is cleared when the reading has been finished (S62). Thereafter, the controller 130 determines whether or not the transfer of the image for the final page on the sheet 1 has been finished (S63). The controller 130 stops the motor when the transfer has been finished (S64). The controller 130 waits the finish of the transfer, and stops the motor when the transfer has been finished when the transfer of the image in the final page has not been finished.

Meanwhile, the formation of the concentration detection pattern is not conducted when the concentration detection color decision part 134 has judged that there is no color in which the print page amount counted value exceeds the concentration detection performance page amount in S58. The controller 130 determines whether or not the transfer of the image in the final page to the sheet 1 has been finished (S63), and stops the motor when the transfer has been finished (S64).

Next, the operation timing of the pattern generation part 140, the image forming unit 150, the concentration sensor 70, the drive motor 170 and the medium feeding carrying part 180 in a process for the concentration detection of the present embodiment.

Figure 8A:
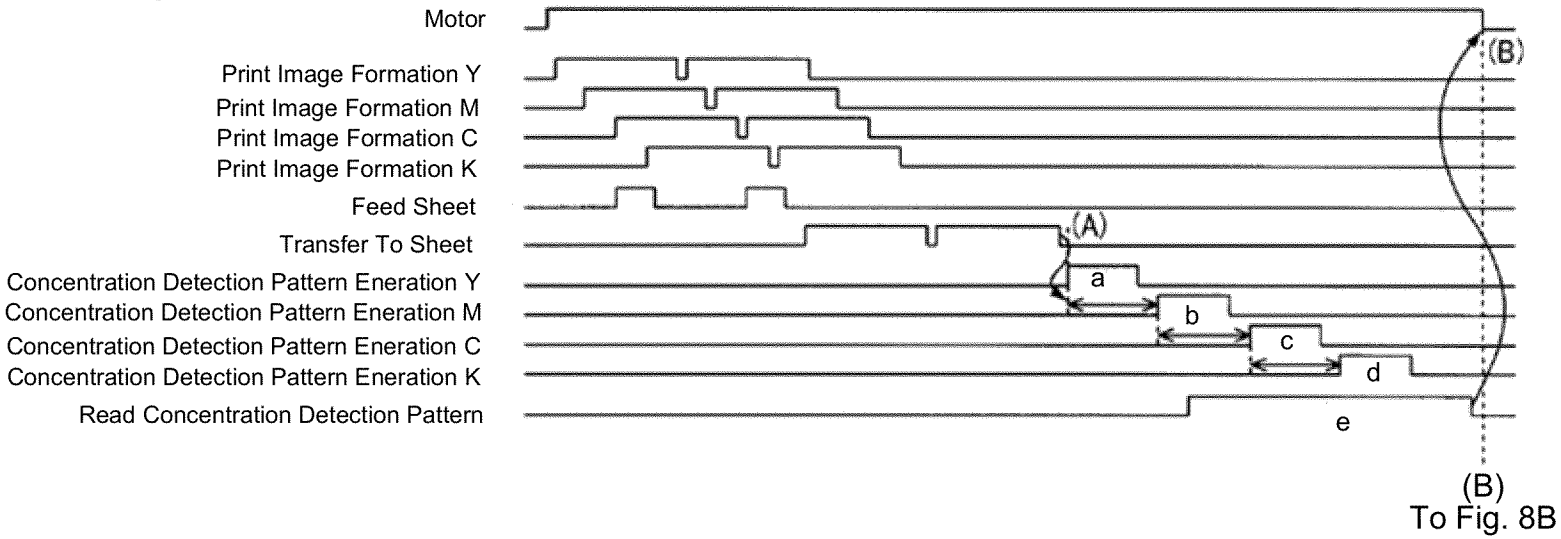
FIGS. 8A-8C are time charts illustrating a process of the concentration detection in the second embodiment.
Figure 8B:
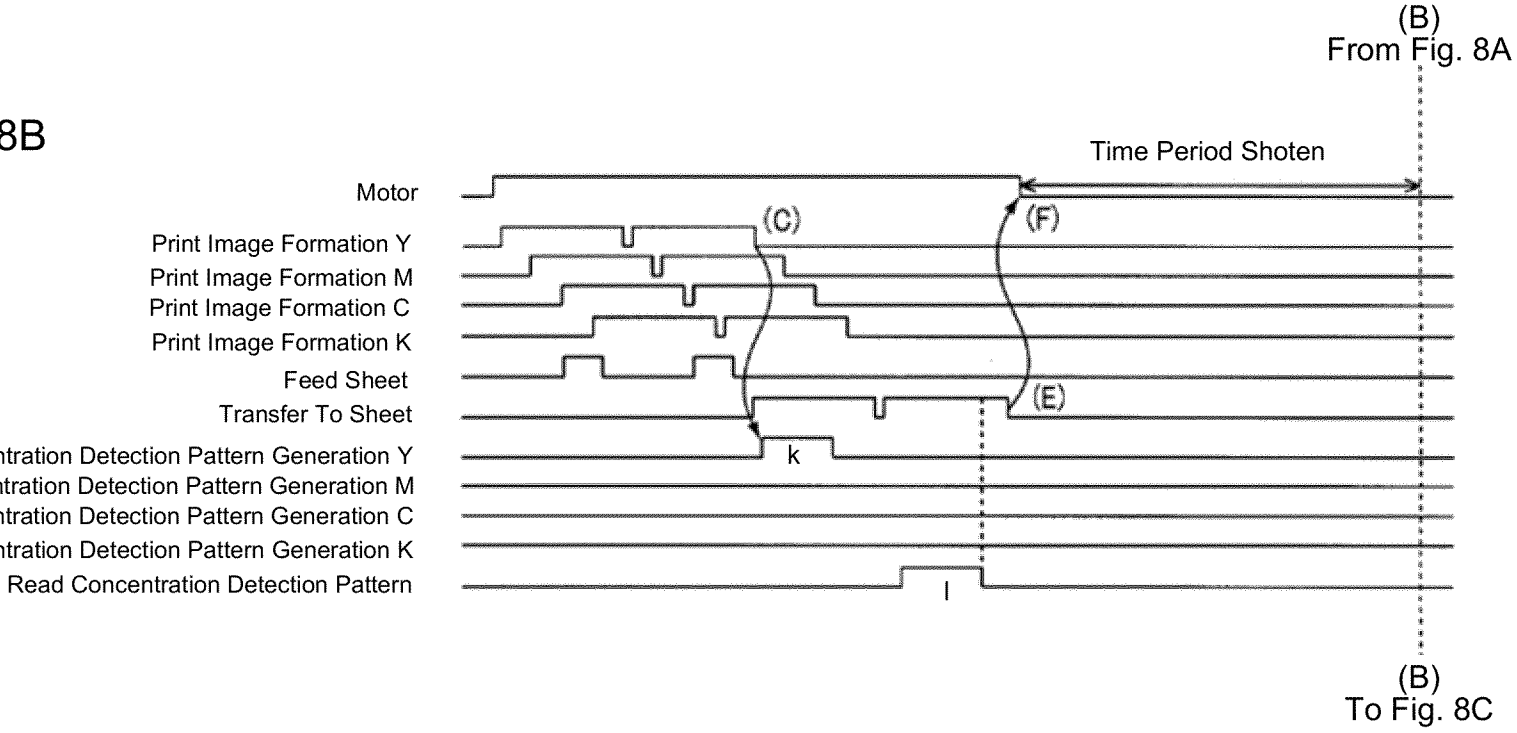
Figure 8C:
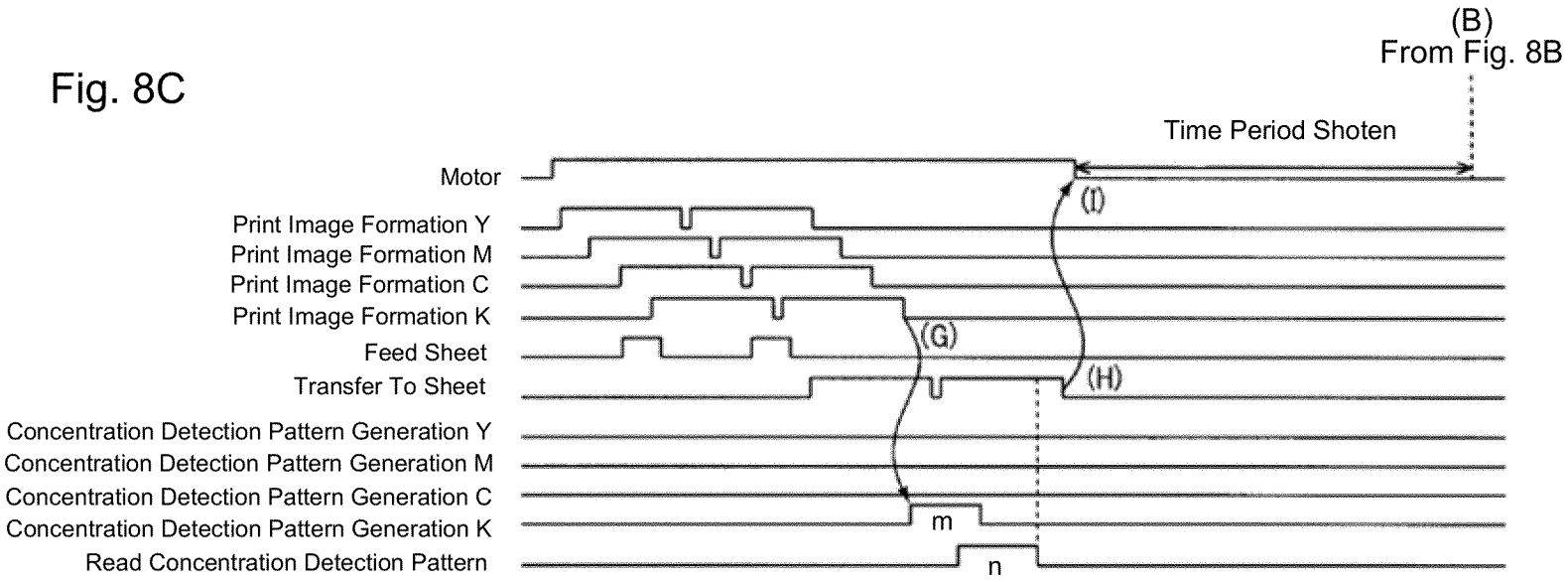

FIGS. 8A-8C are time charts illustrating the process of the concentration detection. FIG. 8A illustrates a case when the concentration detection is conducted after the finish of the transfer of the toner image to the sheet according to the conventional art. FIG. 8B illustrates an example that the concentration detection for a color which forms an image at first is conducted among cases that the concentration detection in a designated color is immediately conducted after the formation of each toner image in each color according to the present invention at the time of the printing of the final page every print job. FIG. 8C is the same case as FIG. 8B and illustrates an example that the concentration detection for a color which forms an image at last is conducted. All of FIGS. 8A-8C assume a job for printing two sheets.

In the case of FIG. 8A, after the activation of the drive motor 170, the image forming part 50 of the image forming unit 150 forms each print image (toner image) in each of Y, M, C and K. The transfer of the print image is performed to the sheet 1, which is supplied by the medium feeding carrying part 180 at the timing of the formation of the toner image, by the secondary transfer roller 55 of the image forming part 150.

At the timing (A) when the transfer to the second sheet that is the final page has been finished, the pattern generation part 140 generates each concentration detection pattern in each color (a, b, c, d). The concentration sensor 70 starts the reading of the toner image formed by the concentration detection pattern after a predetermined time period from the generation of the first concentration detection pattern Y (e). After the generation of the concentration detection pattern K (d), the concentration sensor 70 ends the reading of the toner image formed by the concentration detection pattern after the predetermined time period has elapsed. Thereafter, the drive motor 170 stops. The character (B) in FIG. 8A illustrates the timing at the stop.

By controlling in the manner mentioned above, the reading of each toner image formed by each concentration detection pattern in each color is conducted.

Each of arrows shown at respective portions of the concentration detection pattern generation in the respective colors (a, b, c, d) in FIG. 8A indicates a time length to the start of the generation of a concentration detection pattern in a next color. Each time length is defined by the following formula:

Time Length=(Pattern length)+(Distance between photosensitive drums)−(Distance between image writing head and primary transfer roller).

Each trail edge of each arrow indicates the timing of the start of the generation of the concentration detection pattern in the next color.

Meanwhile, in the case of the present embodiment illustrated in FIG. 8B, after the activation of the drive motor 170, the image forming part 50 of the image forming unit 150 forms each print image (toner image) in each of Y, M, C and K. The transfer of each toner image is performed to the sheet 1, which is supplied by the medium feeding carrying part 180 at the timing of the formation of the toner image, by the secondary transfer roller 55 of the image forming part 150. When the formation of the toner image in Y on the second sheet that is the final page has been finished, the pattern generation part 140 immediately starts the generation of the concentration detection pattern after the timing (C), and generates the concentration detection pattern Y (k).

Here, the timing (C) is the earliest timing of timing to ensure an interval where the toner image formed by the concentration detection pattern is not transferred on a margin on the trailing edge of the sheet 1 and to obtain time period that allows the switch of charge polarities of the secondary transfer roller 55.

Then, the concentration sensor 70 performs the reading of the toner image formed by the concentration detection pattern after a predetermined time period from the generation of the first concentration detection pattern Y (1). However, the drive motor 170 waits for the finish of the transfer (E), and stops (F) since the transfer of the print image (toner image) in K to the sheet 1 may not have been finished at the time when the reading has finished. Thereby, the time for the concentration detection in the present embodiment is shorter by the time between the timing (F) shown in FIG. 8B and the timing (B) shown in FIG. 8A in comparison with the concentration detection according to the conventional art.

In addition, in the case of the present embodiment illustrated in FIG. 8C, after the activation of the drive motor 170, the image forming part 50 of the image forming unit 150 forms each print image (toner image) in each of Y, M, C and K. The transfer of the toner image is performed to the sheet 1, which is supplied by the medium feeding carrying part 180 at the timing of the formation of the toner image, by the secondary transfer roller 55 of the image forming part 150. When the formation of the toner image in K on the second sheet that is the final page has been finished, the pattern generation part 140 immediately starts the generation of the concentration detection pattern after the timing (G), and generates the concentration detection pattern K (m).

Here, the timing (K) is the earliest timing of timing to ensure an interval where the toner image formed by the concentration detection pattern is not transferred on a margin on the trailing edge of the sheet 1 and to obtain time period that allows the switch of charge polarities of the secondary transfer roller 55.

Then, the concentration sensor 70 performs the reading of the toner image formed by the concentration detection pattern after a predetermined time period from the generation of the concentration detection pattern K (n). However, the drive motor 170 waits for the finish of the transfer (H), and stops (I) since the transfer of the print image (toner image) in K to the sheet 1 may not have been finished at the time when the reading has finished. Thereby, the time for the concentration detection in the present embodiment is shorter by the time between the timing (B) shown in FIG. 8A and the timing (I) shown in FIG. 8C in comparison with the concentration detection according to the conventional art.

As mentioned above, whether a color of a concentration detection pattern for which the concentration detection is conducted is a color in which the image formation is done at first or a color in which the image formation is done at last, the concentration detections are finished at the same timing. Therefore, regardless of the colors of the concentration detection patterns for which the concentration detection are conducted, concentration detections are finished at the same timing.

In addition, the above-discussed examples are described for the first and final concentration detection patterns Y and K. A process time period for the concentration detection is shortened by conducting the same process mentioned above for the intermediate colors M and C.

Moreover, a length of the concentration detection pattern in one color is set so that a length from the trailing edge of the sheet 1 to the trailing edge of the concentration detection pattern is shorter than a distance from the concentration sensor 70 to the secondary transfer roller 55. Thereby, the time period needing for the concentration detection becomes zero.

As mentioned above, according to the second embodiment, the concentration detection operation is performed immediately after the finish of the formation of the at lease first toner image in the final page that is printed on the sheet 1, and then, one detection color of the concentration detection pattern is detected every print job. Thereby, the time period needed for the concentration detection is shortened advantageously than that of the first embodiment. In addition, consumption amounts of the consumable items are more suppressed advantageously.

Moreover, the length of the concentration detection pattern in one color is set so that the length from the trailing edge of the sheet 1 to the trailing edge of the concentration detection pattern is shorter than the distance from the concentration sensor 70 to the secondary transfer roller 55. Thereby, the time period needing for the concentration detection becomes zero. Furthermore, rotation amounts of the intermediate transfer belt and the photosensitive drums that are consumable items are reduced to zero. As a result, consumption amounts of the consumable items calculated by the rotation amounts are reduced to zero.

The reading process of the toner image based on the concentration detection pattern is conducted before the finish of the transfer of the toner image formed by the print image as the above-discussed first and second embodiments in a case of color printing. On the other hand, in the case of monochrome printing, a process speed is varied to the speed of the reading process of the toner image based on the concentration detection pattern to perform the formation of the toner image based on the concentration detection pattern and the reading performance after the finish of the transfer of the toner image formed by the print image to sheet 1 since the process speed is faster than the speed of the concentration detection in the monochrome printing.

In addition, in the above-discussed first and second embodiments, the secondary transfer roller 55 approaches and separates the intermediate transfer belt 40, and is controlled to separate the intermediate transfer belt 40 when the toner image based on the concentration detection pattern passes the second transfer position. As a result, the toner image based on the concentration detection pattern is prevented from being attached to the secondary transfer roller 55.

The above-discussed first and second embodiments are explained with the concentration detection as an example. However, processes and effects similar to those of the embodiments are implemented in color shift detection conducting an adjustment of a print position in each color. Furthermore, the first and second embodiments are explained with a printer as an example. However, the present invention is not limited to the printer but may be used in all of image forming apparatuses that use an intermediate transfer belt to print with electrographic method such as a photocopy machine, a facsimile machine, a multi function peripherals (MFP) and the like.

In the above-discussed second embodiment, a print number in each color is counted and then the concentration detection is performed for a color in which a counted value of the print number has exceeded the concentration detection performance page amount. However, a dot number in each color or a rotation number of a photosensitive drum corresponding to each color may be counted and the concentration detection may be performed for a color in which the counted value has exceeded a predetermined threshold value instead of the print number in each color.

What is claimed is:

1. An image forming apparatus in which an image forming part that forms a developer image is located close to an endless intermediate transfer belt, configured to transfer the developer image that is formed by the image forming part to the intermediate transfer belt at a first transfer position and to carry the developer image, then to transfer the developer image on the intermediate transfer belt to a sheet at a second transfer position, the image forming apparatus comprising:

a detection part located between the first transfer position and the second transfer position and configured to detect a concentration of the developer image on the intermediate transfer belt; and a controller configured to start a transfer of a concentration detection pattern that is a developer image for concentration detection to the intermediate transfer belt during a period from when the developer image for print that is the developer image based on print data input from an external part is transferred to the intermediate transfer belt to when the developer image for print is transferred to the sheet, and then to control the detection part to read the concentration detection pattern, wherein the image forming part is configured from a plurality of color image forming parts that correspond to respective colors, the controller comprises a color judgment part that judges whether or not a predetermined condition for each color developer is satisfied for forming the concentration detection pattern, and the controller causes the color image forming part to generate the concentration detection pattern using only the color developer for which the color judgment part judges that the predetermined condition has been satisfied.

2. The image forming apparatus of claim 1, wherein the sheet comprises a plurality of sheets;

the print data is data that corresponds to the plurality of sheets, and the controller starts the transfer of the concentration detection pattern that is the developer image for concentration detection to the intermediate transfer belt during a period from when the developer image for print based on print data that corresponds to a final sheet of the plurality of sheets is transferred to the intermediate transfer belt to when the developer image for print is transferred to the final sheet.

3. The image forming apparatus of claim 1, wherein the predetermined condition is for allowing formation of the concentration detection pattern.

4. The image forming apparatus of claim 3, wherein the predetermined condition is a predetermined page amount, and the controller causes the image forming part to generate the concentration detection pattern when a print page amount has reached the predetermined page amount.

5. The image forming apparatus of claim 1, wherein each of the color image forming parts is located along the intermediate transfer belt.

6. The image forming apparatus of claim 1, wherein the predetermined condition is a predetermined page amount, and the controller causes the color image forming part, to generate the concentration detection pattern when a print page amount has reached the predetermined page amount.

7. The image forming apparatus claim 1, wherein the predetermined condition is a predetermined dot number for each color, and the controller causes the color image forming part to generate the concentration detection pattern when a dot number in each color corresponding to the developer image reaches the predetermined dot number for each color.

8. The image forming apparatus of claim 1, further comprising:

a transfer roller located at the second transfer position to face the surface of the intermediate transfer belt as a part configured to transfer the developer image for print on the intermediate transfer belt to the sheet, the transfer roller being able to approach to and to separate from the intermediate transfer belt, wherein the controller controls so that the transfer roller separates from the intermediate transfer belt when the developer image for concentration detection passes the second transfer position.

9. The image forming apparatus of claim 1, wherein an interval between the developer image for print that is transferred to the intermediate transfer belt and the developer image for concentration detection is at least long enough so that the developer image for concentration detection is not transferred to a margin on a trailing edge of the sheet.

10. The image forming apparatus of claim 1, wherein in case where the color developer that forms the developer image is negatively chargeable developer, by ensuring a predetermined interval between the developer image for print and the developer image for concentration detection, a transfer roller is positively-charged when the developer image for print is transferred to the sheet at the second transfer position, and the transfer roller is negatively-charged when the developer image for concentration detection passes the second transfer position.

* * * * *